US008367978B2

(12) United States Patent
Williams

(10) Patent No.: US 8,367,978 B2
(45) Date of Patent: Feb. 5, 2013

(54) HYBRID INFRARED CONVECTION PAINT BAKING OVEN AND METHOD OF USING THE SAME

(75) Inventor: Glenn Williams, Holly, MI (US)

(73) Assignee: Magna International Inc., Aurora, Ontario (CA)

( * ) Notice: Subject to any disclaimer, the term of this patent is extended or adjusted under 35 U.S.C. 154(b) by 1740 days.

(21) Appl. No.: 11/543,470

(22) Filed: Oct. 5, 2006

(65) Prior Publication Data

US 2008/0099459 A1 May 1, 2008

(51) Int. Cl.
*F27B 9/10* (2006.01)
*F27B 9/36* (2006.01)

(52) U.S. Cl. ..... 219/388; 219/400; 219/411

(58) Field of Classification Search ..... None
See application file for complete search history.

(56) References Cited

U.S. PATENT DOCUMENTS

| | | | | | |
|---|---|---|---|---|---|
| 2,349,300 | A | * | 5/1944 | Olsen | 34/266 |
| 2,360,257 | A | * | 10/1944 | Muller et al. | 34/266 |
| 2,472,293 | A | * | 6/1949 | Groven | 34/60 |
| 3,591,767 | A | * | 7/1971 | Mudie | 219/244 |
| 4,416,068 | A | * | 11/1983 | Nilsson et al. | 34/267 |
| 4,546,553 | A | * | 10/1985 | Best | 34/266 |
| 4,771,728 | A | | 9/1988 | Bergman, Jr. | |
| 4,785,552 | A | * | 11/1988 | Best | 34/418 |
| 4,849,598 | A | * | 7/1989 | Nozaki et al. | 219/601 |
| 4,907,533 | A | * | 3/1990 | Nelson et al. | 118/663 |
| 4,908,231 | A | * | 3/1990 | Nelson et al. | 427/542 |
| 5,023,116 | A | * | 6/1991 | Williams et al. | 427/424 |
| 5,060,594 | A | | 10/1991 | Tomioka et al. | |
| 5,155,335 | A | | 10/1992 | Habaki et al. | |
| 5,165,969 | A | * | 11/1992 | Barlett et al. | 427/483 |
| 5,230,161 | A | * | 7/1993 | Best | 34/267 |
| 5,235,757 | A | | 8/1993 | Josefsson et al. | |
| 5,323,485 | A | | 6/1994 | Josefsson et al. | |

(Continued)

FOREIGN PATENT DOCUMENTS

| | | |
|---|---|---|
| EP | 0369477 B1 | 9/1993 |
| JP | 03026366 A2 | 2/1991 |

(Continued)

OTHER PUBLICATIONS

Custom Coating Systems and Decorative Masking; By Conforming Matrix Corporation,1939.

*Primary Examiner* — Joseph M Pelham
(74) *Attorney, Agent, or Firm* — Warn Partners, P.C.

(57) ABSTRACT

An infrared convection paint baking oven comprising a tunnel having an entrance and exit, the tunnel having top and side walls equipped with air ducts that communicate with a at least one air pressure blower to form an air plenum in the interior of said tunnel. The oven is equipped with at least one exhaust to re-circulate heated air and vent moisture and volatiles from said tunnel. The exhaust communicates said pressure blower with air make up and an RTO. The re-circulated air flow is divertible from the exhaust to the furnace to control temperature and VOC emissions. Infrared light assemblies are arranged in said tunnel interior on the top and side walls such that air from said plenum is circulated around said light assemblies to form a convection air current. The light assemblies are in close proximity to each other at the entrance and along a distance of said tunnel to form a warm up zone. The light assemblies are spaced further apart along the remainder of said tunnel length toward said exit to form a curing zone.

18 Claims, 4 Drawing Sheets

U.S. PATENT DOCUMENTS

| | | | | |
|---|---|---|---|---|
| 5,340,089 | A | 8/1994 | Heath et al. | |
| 5,551,670 | A | 9/1996 | Heath et al. | |
| 5,588,830 | A * | 12/1996 | Josefsson et al. | 432/147 |
| 5,603,769 | A * | 2/1997 | Okubo et al. | 118/621 |
| 5,906,485 | A * | 5/1999 | Groff et al. | 432/121 |
| 6,062,850 | A * | 5/2000 | Ino et al. | 432/143 |
| 6,113,764 | A | 9/2000 | Emch | |
| 6,231,932 | B1 | 5/2001 | Emch | |
| 6,257,297 | B1 | 7/2001 | Chenetski | |
| 6,291,027 | B1 * | 9/2001 | Emch | 427/542 |
| 6,319,562 | B1 | 11/2001 | Arverus et al. | |
| 6,546,647 | B2 * | 4/2003 | Speck | 34/468 |
| 6,596,347 | B2 * | 7/2003 | Emch | 427/542 |
| 6,617,589 | B2 | 9/2003 | Ueno | |
| 7,011,869 | B2 * | 3/2006 | Emch | 427/542 |
| 7,063,528 | B2 * | 6/2006 | Klobucar et al. | 432/147 |
| 7,077,547 | B2 * | 7/2006 | Schmitkons et al. | 392/420 |
| 7,488,518 | B2 * | 2/2009 | Ortlieb et al. | 427/491 |
| 7,658,017 | B1 * | 2/2010 | Laviolette et al. | 34/403 |
| 2002/0148137 | A1 | 10/2002 | Eisenacher et al. | |
| 2004/0101635 | A1 * | 5/2004 | Ortlieb et al. | 427/569 |
| 2005/0087183 | A1 * | 4/2005 | Klobucar et al. | 126/21 A |
| 2007/0292815 | A1 * | 12/2007 | Klobucar et al. | 432/145 |
| 2009/0017408 | A1 * | 1/2009 | Pakkala et al. | 432/145 |

FOREIGN PATENT DOCUMENTS

| | | | |
|---|---|---|---|
| JP | 03176139 | A2 | 7/1991 |
| JP | 05177160 | A2 | 7/1993 |
| JP | 2005077009 | A2 | 3/2005 |
| RU | 2265169 | | 11/2005 |

* cited by examiner

HYBRID INFRARED CONVECTION PAINT BAKING OVEN AND METHOD OF USING THE SAME

BACKGROUND OF THE INVENTION

1. Field of the Invention

The present invention relates to an infrared convection paint-baking oven that uses infrared lamps to directly apply heat to the painted part and uses air from a blower to supply convection to the infrared heat and evenly distribute the heat throughout the oven interior to evenly cure paint finishes on parts arranged therein.

The present invention further relates to a method of efficiently paint baking automotive parts arranged on a conveyer in an oven that reduces the time necessary to cure such parts over prior art ovens and processes.

The present invention further relates to an infrared convection paint baking oven wherein the infrared light assemblies are arranged such that they are diagonally opposed to each other and the articles to be cured, so that the heat provided by such light assemblies is circulated through the oven interior and the automotive parts by convection air currents, thereby resulting in an even temperature throughout the curing process and a extended lamp life due to the circulation of air around the light assemblies.

2. Detailed Description of the Related Art

Josefsson et al., U.S. Pat. No. 5,235,757 discloses a convection air holding zone in a camel back paint oven that utilizes turbulent ejector air flow along paths parallel to the path of travel of the article being baked in a paint bake oven. Air recirculation means are provided within the convection air holding zone which filters dirt particles from the air and a heat source is applied to the air to compensate for temperature loss due to heat exchange with the article and oven walls. Maintaining a turbulent air flow over the article being baked in the convection air hold zone helps insure an even temperature throughout the zone, thereby enabling a more consistent paint finish on the article. Dark radiation panels are used to supply heat to the oven. There is no disclosure of using infrared lamp assemblies in combination with convection air currents to maintain the heat in the oven at a consistent temperature.

Josefsson et al., U.S. Pat. No. 5,323,485 discloses a paint baking oven having a bring up zone utilizing short and medium wave infrared lamps to raise the component temperature up to a desired level. Once within the paint baking oven, a computer activates the requisite number of infrared lamps at the proper intensity to achieve the desired component temperature. While the infrared lamps are activated, inlet air is directed over the lamps to prevent them from overheating. The invention allows for smoother car finishes by preventing bubbling, pops, and raises the component temperature more quickly than conventional dark radiation panels. Josefsson et al specifically state that the heating means generally comprise a plurality of centrally directed infrared lamps extending from a frame member which selectively projects radiation onto the component as it passes through the leading end of the bring up zone. The bring up zone further includes an air inlet system for bringing air into the interior of the bring up zone. The air serves to cool the infrared lamps which are susceptible to overheating. Once the inlet air approaches the entrance end of the bring up zone, it is recirculated back into the bring up zone by a draft of air introduced by a blower. The air passes through a filter to remove solvents and dust and is then reintroduced into the bring up zone. There is no disclosure of arranging the infrared lamps in a diagonally opposed manner and neither is there a disclosure of using infrared lamps to provide heat throughout the entire length of the paint bake oven and neither is there any disclosure of using recirculated air to create a convection heat throughout out the entire length of the paint bake oven to provide and even temperature throughout the length of the paint bake oven.

Habaki et al., U.S. Pat. No. 5,155,335 discloses an oven for baking a powdered coating material to an object. The oven has an inlet air shield chamber connected to the inlet side of a horizontal heating chamber. The inlet air shield chamber is provided therein with a radiation heat source which heats the object and the layer of coating powder to a temperature substantially equal to the baking temperature before the object enters into a horizontal heating chamber. The horizontal heating chamber is provided with a source of heated air from a gas fired hot air generator.

There is no disclosure of using infrared heat lamps arranged in a diagonally opposed manner together with recirculated air to provide a convection air flow to maintain a consistent baking temperature throughout the entire length of a paint baking oven.

Nelson et al., U.S. Pat. No. 4,908,231 discloses a process and apparatus for heat treating a coating applied to an automobile body. The process includes the steps of radiant heating of a coating prior to convection heating.

The present invention is directed to a process and apparatus for applying radiant heat as well as convention heating simultaneously to cure an article to be coated.

Emch, U.S. Pat. No. 6,231,932 discloses a process for drying or curing top coatings and multi-component composite coatings applied to surfaces of metal or polymeric substrates which include applying infrared radiation and warm low velocity air simultaneously to the coating for a period for at least about 30 seconds and increasing the substrate temperature at a predetermined rate to achieve a specified peak temperature. Infrared radiation and hot air are applied simultaneously to the coating for at least about three minutes and the substrate temperature is increased at a predetermined amount to achieve a specified peak temperature, such that a dried and/or cured coating is formed upon the surface of the substrate. The specified peak temperature for exposing the top coating is 10° C. to 40° C. for a period of about 30 seconds and then applying the infrared and warm air at a volume not to exceed 4 meters per second, and the temperature should not exceed 25° C. to 50° C., and then applying infrared and hot air for at least 30 seconds so that the temperature of the metal substrate is increased to a range of about 65° C. to 140° C. to dry the top coat.

The present invention is directed to a paint bake oven that uses infrared lamp assemblies in a specific arrangement to heat the substrate of an article to be cured to about 265° C. for about 2 minutes, and then uses infrared radiation and convention air currents to maintain the temperature for an additional 8 to about 20 minutes, depending upon the finish being cured. The temperature ranges and the times used are outside the ranges contemplated by Emch '932.

Emch, U.S. Pat. No. 6,133,764 discloses a process of drying a liquid electro deposited coating composition applied to a metal substrate. Infrared radiation and warm air are applied simultaneously to the electrodeposited coating composition for a period of at least about 1 minute and the velocity of air at the surface of the electro-deposited coating composition for a period of about 1 minute, the velocity of the air at the surface of the electro-deposited coating being less than about 4 meters per second. The temperature of the metal is raised in a controlled manner to about 35° C. to 140° C. Infrared radiation and hot air are then applied for a period of at least 2 minutes to achieve a temperature of the substrate of about 160° C. to about 215° C. such that the dried electrodeposited coating is formed upon the surface of the metal substrate.

The present invention is directed to a paint bake oven that uses infrared lamp assemblies in a specific arrangement to heat the substrate of an article to be cured to about 265° C. for about 2 minutes, and then uses infrared radiation and convention air currents to maintain the temperature for an additional 8 to about 20 minutes, depending upon the finish being cured. The temperature ranges and the times used are outside the ranges contemplated by Emch '764.

SUMMARY OF THE INVENTION

The present invention is an infrared convection paint baking oven, comprising; a top, a bottom and sidewalls extending substantially unbroken therebetween to define a tunnel having length, width and height, an interior, an exterior, an entrance and exit. The tunnel is adapted to bake at least one article moved along the length of the tunnel from the entrance to the exit. The top and side walls are equipped with air ducts that communicate with at least one air pressure blower and fresh air make up to form an air plenum in the interior of said tunnel. The paint baking oven is further equipped with at least one exhaust to vent moisture and volatile laden air from the tunnel. The exhaust temperature is used to control said recirculation pressure blower that draws in fresh air to control and maintain ambient oven tunnel temperature of about 265° F. The air-flow is at least partially divertible after the exhaust where the volume of exhausted air to the Rotary Thermal Oxidizer is equal to the volume of the introduction of fresh air. The infrared light assemblies are arranged in the tunnel interior on the top and side walls such that air from the plenum is circulated around the light assemblies to form a convection air current. The light assemblies are positioned in close proximity to each other at said entrance and along a predetermined distance of said length of said tunnel to form a preheat area. Thereafter, the light assemblies are spaced further apart along the remainder of said tunnel length toward the exit. The sidewalls are preferably have and accordion profile, and the lights are positioned on the accordion profile side walls such that they are diagonally opposed to each other and the direction of the light beams from the light assemblies are diagonally directed relative to the article in the tunnel.

The present invention is also directed to a method of baking an article with a paint finish using infrared convention paint baking oven, comprising:

(a) introducing a coated article to be baked into a warm up zone of said paint baking oven;

(b) applying infrared radiation to said warm up zone to heat the article to about 265° C. and injecting a volume of air around and through said infrared lights to cool said infrared lights and heat said air into a convection air current that evenly distributes said infrared heat into said air convection current for about 2 minutes;

(c) moving said article to a curing zone and suing infrared radiation and convention air current to maintain said temperature at about 265° C. for about 8 to 20 minutes;

(d) exhausting a volume of air containing volatiles, particulates and moisture from said tunnel such that the volume of air exhausted to the RTO equals the volume of replacement fresh air injected into the re-circulated oven air;

(e) re-circulating the exhausted air through an air duct system into an air pressure blower for re-introduction into the paint baking infrared convection oven.

DETAILED DESCRIPTION OF THE PREFERRED EMBODIMENT(S)

Figure 1:
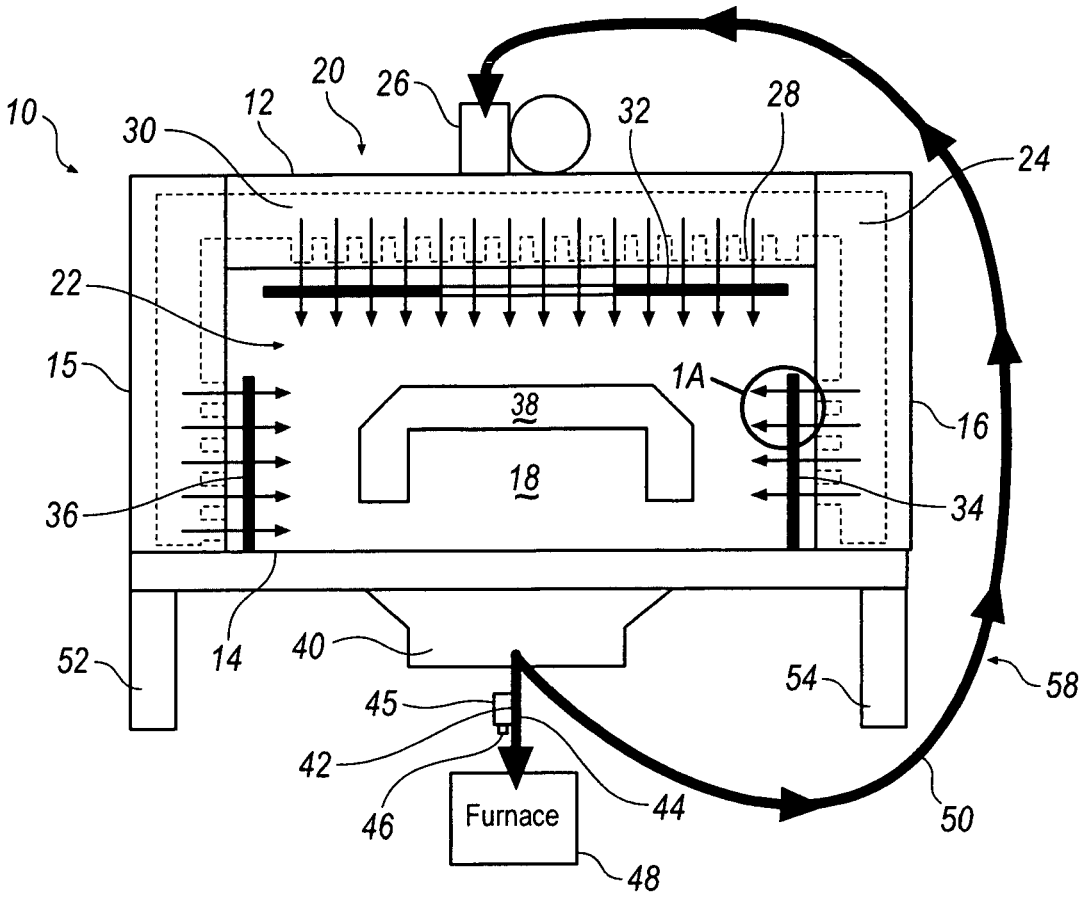
FIG. 1 is a schematic sectional view of the paint bake oven of the present invention.

Turning now to the drawings wherein like numbers refer to like structures, and particularly to FIG. 1, infrared convection paint bake oven 10 is schematically presented in sectional form. Oven 10 has a top 12 and a bottom 14 substantially parallel to each other. The top and bottom are separated by sidewalls 15 and 16 that extend substantially parallel to each other and substantially unbroken therebetween to define a tunnel 18. The bottom has at least two, and preferably a series, of legs 52, 54 arranged periodically along its length. The tunnel has an exterior 20 and an interior 22. The sidewalls and top may be hollow and serve as ducts, or may be equipped with air ducts 24 that are connected to at least one air pressure blower unit 26 at one end and terminate in a series of openings 28 that communicate with the interior of the tunnel such that an air plenum 30 is formed to facilitate the movement of air from the blower through the ducts into the interior of the tunnel. A series of infrared lamp assemblies 32, 34, and 36 are arranged on the interior of the tunnel sidewalls and the top of the tunnel oriented to facilitate the heating of air to cure the finish or paint of an article 38 arranged in the tunnel interior. The oven is further equipped with an exhaust 40 on its bottom surface exterior and communicating with the interior of the tunnel so that moist hot air may be re-circulated and exhausted from the interior of the tunnel. A sensor 42 is arranged in a duct 44, and senses the presence of volatiles or particulate matter in the exhaust air and generates a signal to a computer 45 to control a valve 46 in the duct to vent the air through a furnace 48. The furnace heats the air and combusts the dust and or volatiles and vents the treated air through a common air duct 50 back to the air pressure blower for reintroduction into the interior of the tunnel to assist in the curing of the article to be treated. When there are no or insufficient volatiles or particulate 46 remains closed, thereby venting the air through the common air duct 50 to the air pressure blower. The entire air duct valve, sensor furnace and return duct constitute an air recirculation system 58. Thus, it may be understood that the system is a closed system and the release of volatiles or particulate matter into the environment is greatly reduced or eliminated.

Figure 1A:
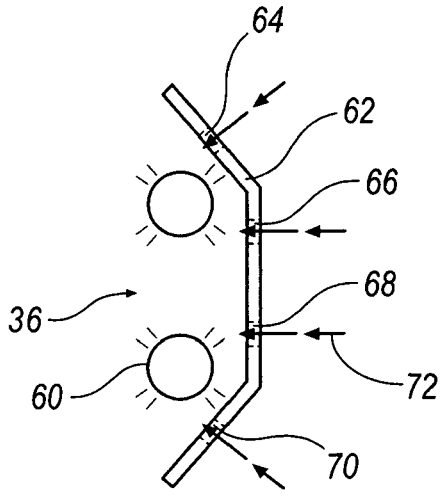
FIG. 1A is a detailed view of the infrared light assembly shown in FIG. 1.

FIG. 1A is a detailed view of the light assembly depicted in FIG. 1, showing its construction. Specifically, light assembly 36 is comprised of lamps 60, shown as arranged parallel to each other and partially surrounded by reflector 62. The lamps are medium wave quartz infrared lamps with gold reflector backing and usually operate at an air temperature between 1000° F. and 1500° F. At this temperature, the lamp has an operating life of about 20,000 hours. In order to extend the life of the lamps, reflector 62 has apertures 64, 66, 68 and 70 arranged therethrough and oriented to facilitate the circulation of air from the air plenum through the reflector and around the lamps 60, as indicted by air flow 72, depicted by the arrows. The air flow through the reflector and around the lamps serves to cool the lamps such that they operate at an air temperature of about 265° C., thereby extending their operating lives, and producing hot air as a result of air moving through the reflector and coming into close contact with the lamps that is at about 265° C. The action of the exhaust draws the heated air through and around the article to be cured. This circulation of heated air has two important effects. First, the movement off the heated air around the article serves as a three dimensional drying aid by passing heated air over, around and through the article, thereby ensuring there are no uncured areas of the article to be treated. Secondly, the heated air serves to "wick" or evaporate any moisture and volatile organic compounds in the tunnel or from the article being treated and ensure that it is drawn through the exhaust whereby a portion of the air is bled off for subsequent treatment and the balance of the air is re-circulated back to the air pressure blower as described with reference to the air recirculation system set forth above. In addition, this arrangement and light assembly eliminates the need for dark panel heat that is present in many of the paint bake ovens of the prior art. The use of infrared lamps as described will reduce the amount of time necessary to cure a painted article to about half the time necessary to cure a painted article using convection ovens of the prior art.

Figure 2:
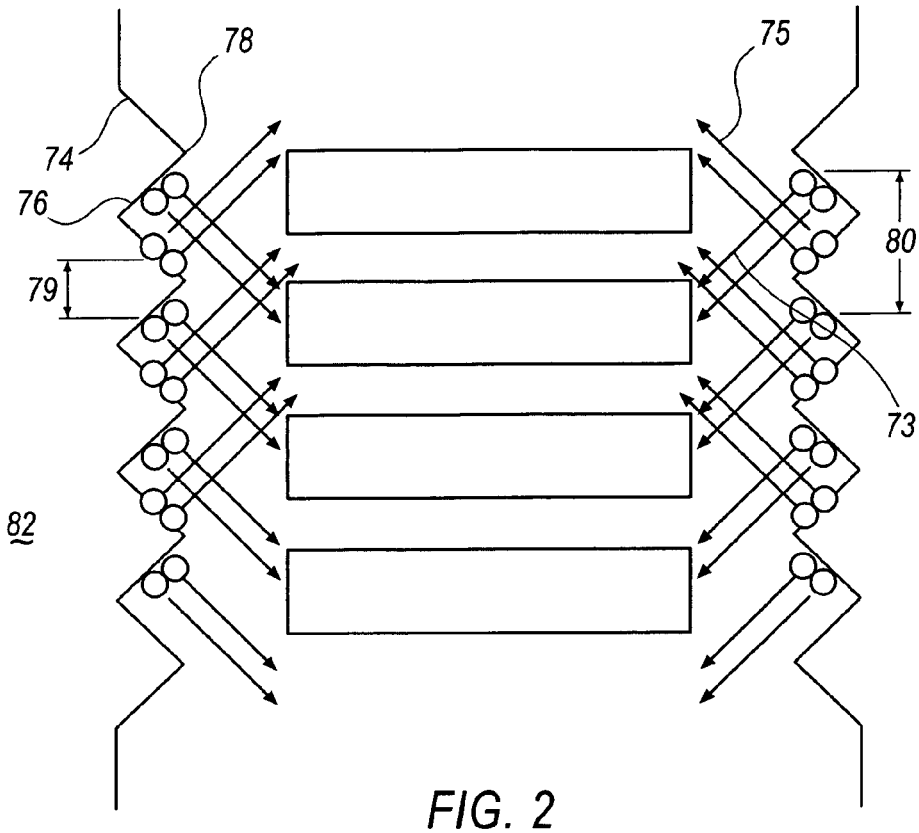
FIG. 2 is a schematic top view of the paint bake oven of FIG. 1, showing the construction of the walls and the orientation of the light assemblies.

FIG. 2 is a top schematic view of a section the oven of the present invention detailing the construction of the sidewalls and the orientation of the lamp assembles on the sidewalls in the warm up zone 82 of the oven. Specifically, the side walls have an accordion construction shown by a series of angled surfaces 74 and 76 that intersect at an apex 78 on each of the sidewalls, to present the accordion construction of the sidewalls. Those skilled in the art will recognize that each sidewall is identical to the other, and the description made with reference to one sidewall will apply to the construction of the opposite sidewall. The lamp arrays are arranged on the angled surfaces 74 and 76 such that each lamp within a single assembly is spaced no more than about six inches apart from the next lamp centerline 79. In the warm up zone, each lamp assembly is oriented such that each lamp assembly pointing in the same direction has a centerline 80 of about 12 inches as measured between adjacent assemblies. It is further noted that the lamp assemblies are oriented such that they are oriented diagonally relative to the article to be cured, as indicated by light rays 75, and each lamp assembly is oriented such that it is diagonally opposed to the adjacent lamp assembly, as indicated by light rays 73. Further, the lamp assemblies are arranged within the tunnel interior such that the distance between the lamps and the article to be cured is at an optimal distance to facilitate curing of the treated article. Preferably, this distance is in the range of about 12 to about 30 inches, and more preferably within the range of about 16 to 26 inches.

Figure 3:
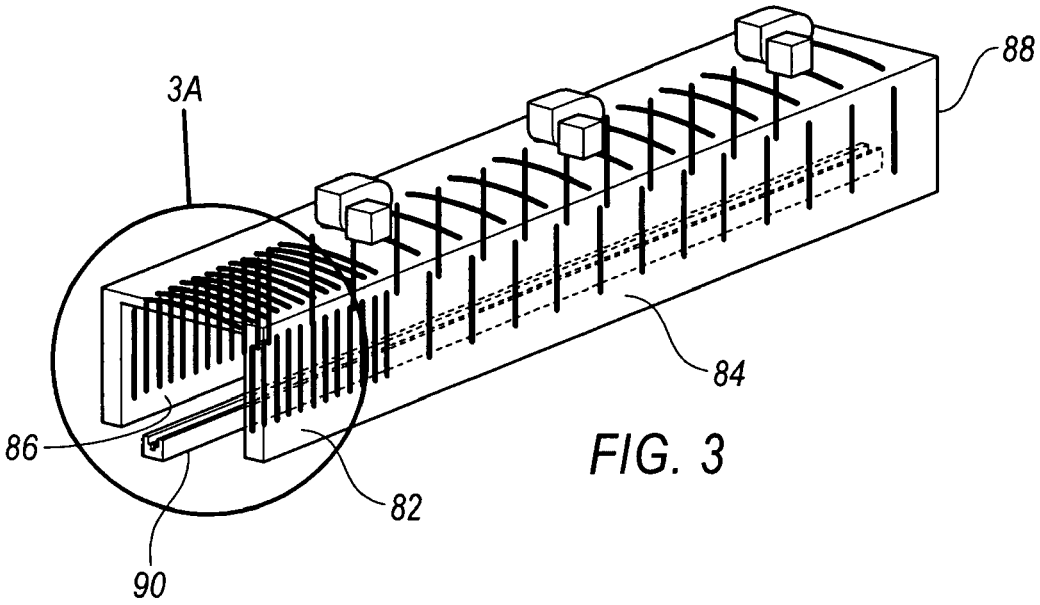
FIG. 3 is a perspective view of the paint bake oven of FIG. 1, showing the arrangement of the light assemblies along the length of the oven.

FIG. 3 is a perspective view of the oven indicating the various zones within the oven. Specifically, warm up zone 82 is illustrated wherein the lamps are more densely populated along the tunnel interior than the curing zone 84, which comprises the remainder of the tunnel length. The warm up zone extends from the entrance 86 of the tunnel a predetermined distance to provide optimal warming of the air to be used in the reset of the tunnel for the curing process. The curing zone extends from the end of the warming zone to the exit 88. Articles arranged on a conveyer 90 enter the tunnel at the entrance, are moved through the warm up zone and the curing zone, and exit the tunnel at the exit fully cured. Those skilled in the art recognize that although the conveyer is shown on the bottom surface of the tunnel, it is contemplated that the top surface could be equipped with the conveyer and the infrared lights carried on the top surface could be mounted on the bottom surface of the tunnel.

Figure 3A:
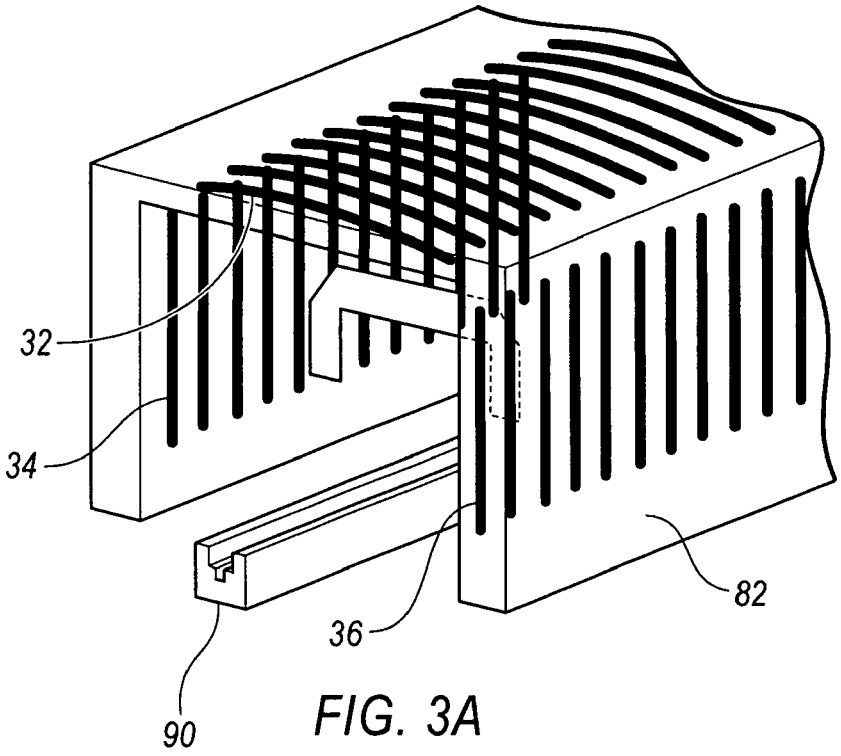
FIG. 3A is a detailed view of the paint bake oven of FIG. 3, showing the arrangement of the infrared light assemblies at the entrance of the paint bake oven.

FIG. 3A is a detailed view of the warm up zone, showing the lamp assemblies arranged in the warm up zone of the paint bake oven and an article to be cured therein. At the warm up zone, the accordion construction of the sidewalls is such that the frequency of the apexes of the intersection of the angled surfaces described in relation to FIG. 2 is greater than the frequency of the apexes of the angled surfaces in the cure zone. The infrared light assemblies are arranged on the angled surfaces. Thus, the warm zone is more densely populated with lamp assemblies that the cure zone.

Figure 4:
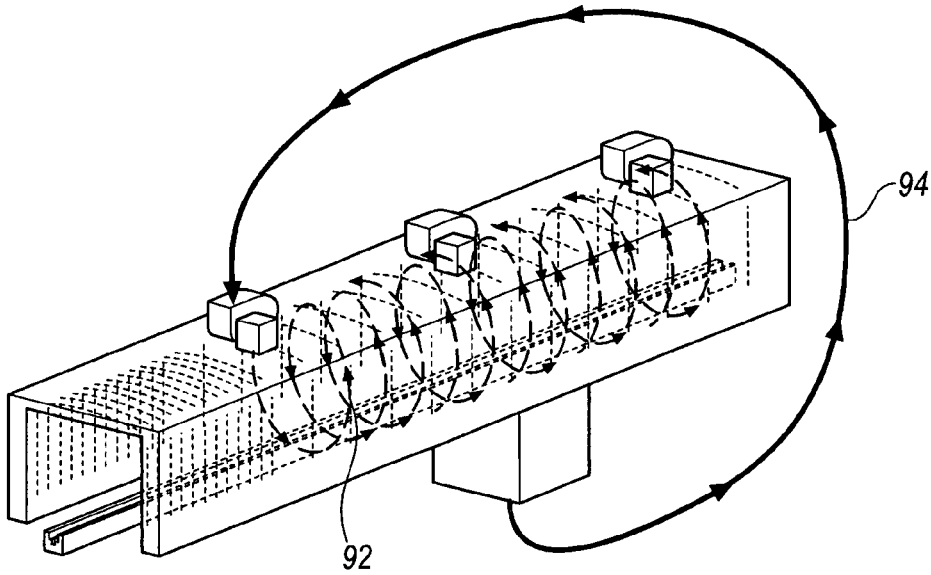
FIG. 4 is a perspective view of the paint bake oven showing the convection air currents within the oven and the recirculation of the air from the intake air pressure blowers to the exhaust to the intake air pressure blowers.

FIG. 4 is perspective view of the paint bake oven of the present invention detailing some aspects of its construction and illustrating the recirculation of air as well as the convection air current within the tunnel interior. Specifically mounted along the top exterior of the paint bake oven is a plurality of air pressure blower units as described in relation to FIG. 1. Ambient air is drawn through the air pressure blower, through the plenum and around the lamp assemblies to create the air convection current 92 that circulates through the tunnel and around the article to be cured. A predetermined amount of air as determined by a computer based upon the signal generated from the sensor as well as other operating parameters of the unit, is released through the exhaust where the presence of volatiles, particulates and moisture is detected as previously described above. If there are sufficient volatiles, particulate impurities, or moisture content, the air is passed to a furnace for treatment to reduce or eliminate the volatiles, moisture or particulates. It is then passed through to the air pressure blower for recirculation into the interior of the tunnel. If insufficient moisture, volatiles or particulates are detected, the exhausted air 94 is not passed though the furnace but rather is re-circulated back to the air pressure blower for reintroduction to the tunnel interior.

Figure 5:
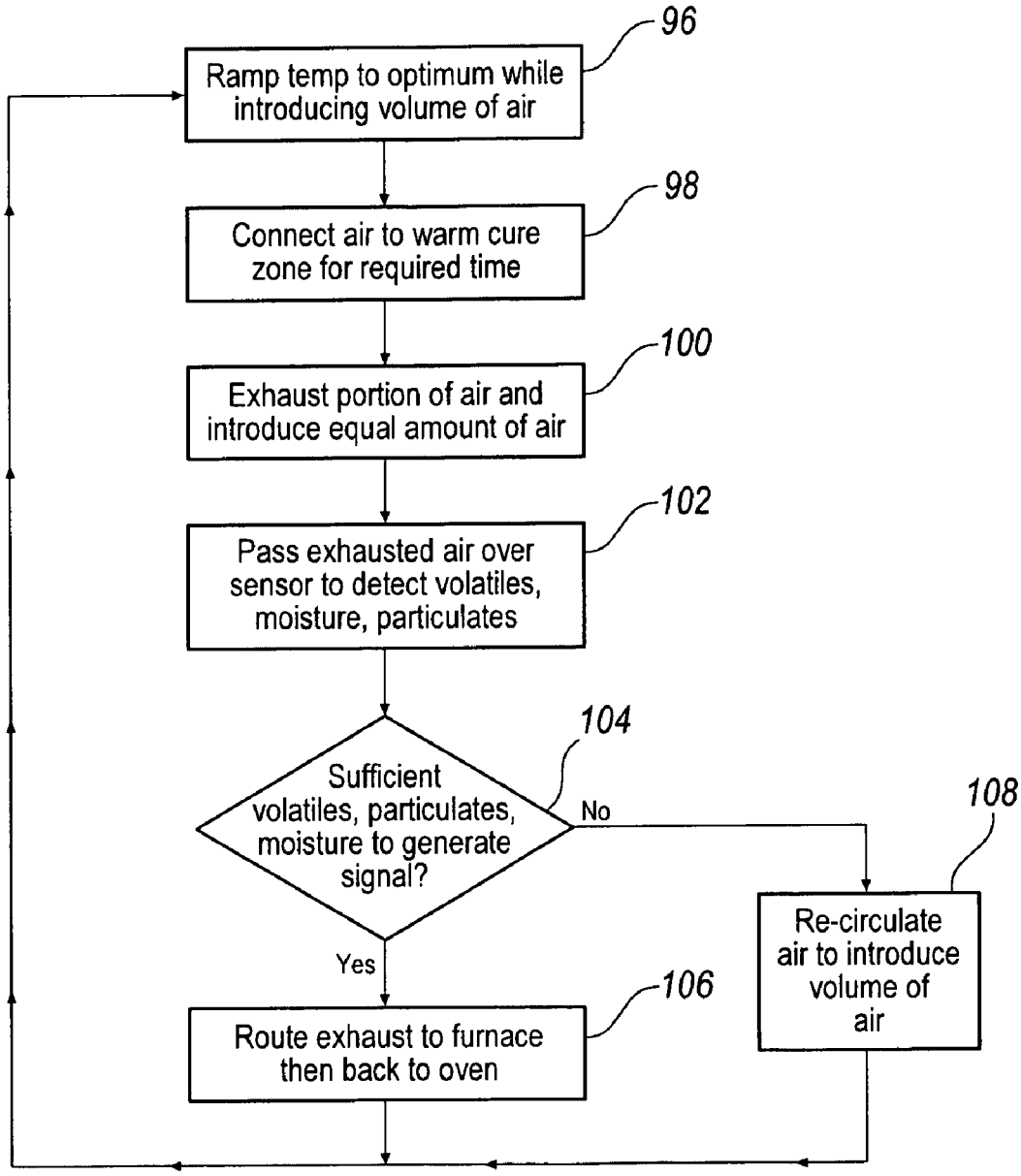
FIG. 5 is a schematic of the method of using the infrared convection paint bake oven of the present invention.

Turning to FIG. 5, in operation, at 96 a volume of air is introduced into the area while the infrared lamps in the warm up zone ramp the temperature in the oven, and subsequently in the article to be cured, to a temperature of greater than about 250° C. in less than about two (2) minutes, and at 98 holds that temperature in the cure zone for an additional about 8 minutes for a two component or low cure solvent based paint finish to about 20 minutes for one component or high cure solvent based paint finished. At 100 air is exhausted from the oven and an equal amount of air is introduced form the blowers. At 102, the exhausted air is passed through a duct that includes a sensor to sense whether there is sufficient moisture, volatiles or particulate matter to generate a signal. If yes, a signal is generated to a computer to actuate a valve to direct moisture, volatile or particulate laden air into a furnace for purification. At 104, the air is recirculated back into the air pressure blowers for reintroduction into the tunnel interior.

The paint bake oven described above offers significant advantages to the conventional convection ovens of the prior art. Specifically, convection bake ovens usually have dwell times of between about 30 to about 50 minutes, depending upon the article to be cured and the paint type. The hybrid infrared convention oven of the present invention reduces dwell times to about 10 to 20 minutes, depending upon the article to be cured and the paint type. The reduction is time necessary to cure an article increases productivity because more parts can be processed in a unit of time than was possible using the conventional convection ovens of the prior art. Moreover, because the heat is supplied by infrared lamps and circulated around the oven by means of a convention air current, energy consumption is reduced by up to 80%. In addition, $CO_2$ emissions are greatly reduced when compared to conventional convection ovens.

The words used in the description of the invention are words of illustration, and not words of limitation. Those skilled in the art will recognize that many various are possible without departing from the scope and sprit of the invention.

I claim:

1. An infrared convection paint baking oven, comprising; a top and a bottom substantially parallel to each other and sidewalls extending substantially parallel to each other and substantially unbroken therebetween to define a tunnel having length, width and height, an interior, an exterior, an entrance and exit; said tunnel adapted to bake at least one article moved along the length of the tunnel from the entrance to the exit; said top and side walls equipped with air ducts that communicate with at least one air pressure blower to form an air plenum in said interior of said tunnel; said paint baking oven further equipped with at least one exhaust to vent moisture, particulate and volatile laden air from said tunnel; said exhaust in air communication with said pressure blower and fresh air introduction; an air flow circulation at least partially divertible from an exhaust re-circulation to a rotary thermal oxidizer (RTO) for volatile organic compound (VOC) incineration; infrared light assemblies arranged in said tunnel interior such that air from said plenum is circulated around said light assemblies to form a convection air current; said light assemblies in close proximity to each other at said entrance and along a predetermined distance of said length of said tunnel to form a warm up zone; said light assemblies spaced further apart along the remainder of said tunnel length toward said exit to form a curing zone wherein said light assemblies raise the temperature of an article to about 265° C. for about 2 minutes in said warm up zone; said light assemblies spaced further apart along the remainder of said tunnel length toward said exit wherein the temperature of the substrate to be treated in the curing zone maintained at about 265° C. for an additional about 8 to 20 minutes in said cure zone to cure the coating applied to the article, wherein said side walls are comprised of an accordion construction comprising a series of angled surfaces that are flat and that intersect at an apex on each of said side walls, said infrared lights emitting light rays in a discrete direction arranged on each of said angled surfaces of said accordion construction side walls, the emitted light rays from adjacent light assemblies are diagonally opposed to one another and also diagonal with respect to an axis extending along the longitudinal direction of the tunnel and an article moving through the tunnel during curing.

2. The infrared convection paint baking oven of claim 1, further comprising a plurality of air pressure blowers arranged along the top exterior of said tunnel; and a plurality of exhausts arranged along the bottom exterior of said tunnel.

3. The infrared convection paint baking oven of claim 1, further including a sensor controlled valve to vent volatile laden air through a furnace.

4. The infrared convection paint baking oven of claim 1, further including a temperature sensor to determine when to activate said air pressure blower.

5. The infrared convection paint baking oven of claim 1, further including a conveyer to move articles through the length of the tunnel.

6. The infrared convention paint baking oven of claim 1, wherein said light assemblies are comprised of infrared lights with reflectors and apertures in said reflectors to facilitate circulation of air therethrough.

7. The infrared convection paint baking oven of claim 1, wherein the light assemblies that are pointing in the same direction have a centerline separated by a distance of about 12 inches as measured between adjacent light assemblies pointing in the same direction.

8. The infrared convection paint baking oven of claim 1, wherein said infrared lights in said are arranged such that adjacent light assemblies on each sidewall in said warm up zone are spaced apart a distance of about 6 inches from each other.

9. The infrared convention paint baking oven of claim 1 wherein the article to be cured is separated from the light assemblies by a distance of about 12 to 30 inches.

10. The infrared convention paint baking oven of claim 1, wherein the article to be cured is separated from the light assemblies by a distance of about 15 to 26 inches.

11. An infrared convection paint baking oven, comprising; a substantially planar top and a bottom, substantially parallel to each other and accordion configured sidewalls substantially parallel to each other and extending substantially unbroken therebetween to define a tunnel having length, width and height, an interior, an exterior, an entrance and exit; said tunnel adapted to bake at least one article moved along the length of the tunnel from the entrance to the exit; said top and side walls equipped with air ducts that communicate with a plurality of air pressure blowers arranged along the exterior top of said tunnel to form an air plenum in said interior of said tunnel; said paint baking oven further equipped with a plurality of exhausts to vent moisture and volatile laden air from said tunnel; said exhausts in air communication with said pressure blowers; said air flow at least partially divertible from said exhaust to a rotary thermal oxidizer (RTO) to control emissions and a re-circulation to oven to control temperature; infrared light assemblies arranged in said tunnel interior on the top and side walls such that air from said plenum is circulated around said light assemblies to form a convection air current; said light assemblies on said side walls arranged on said accordion surfaces that are flat and are in close proximity to each other at said entrance and along a predetermined distance of said length of said tunnel to form a warm up zone; said light assemblies located on each of said accordion surfaces of said sidewalls that are configured as an accordion such that adjacent light assemblies are configured to emit light rays that are diagonally opposed to one another and diagonal to an axis extending along the longitudinal direction of the tunnel and articles to be cured; said light assemblies spaced further apart along the remainder of said tunnel length toward said exit.

12. The infrared convection paint baking oven of claim 11, further comprising a temperature sensor to control the pressure air blowers and fresh air make up.

13. The infrared convention paint baking oven of claim 11, wherein said light assemblies are comprised of infrared lights with reflectors and apertures in said reflectors to facilitate circulation of air therethrough.

14. The infrared convection paint baking oven of claim 11, further comprising a conveyer to move articles longitudinally along the length of said tunnel.

15. The infrared convection paint baking oven of claim 11, wherein said infrared lights are arranged such that the light assemblies that are pointing in the same direction have a centerline separated by a distance of about 12 inches as measured between adjacent light assemblies pointing in the same direction.

16. The infrared convection paint baking oven of claim 11, wherein said infrared lights in said are arranged such that adjacent light assemblies on each sidewall in said warm up zone are spaced apart a distance of about 6 inches from each other.

17. The infrared convention paint baking oven of claim 11, wherein the article to be cured is separated from the light assemblies by a distance of about 12 to 30 inches.

18. The infrared convention paint baking oven of claim 11, wherein the article to be cured is separated from the light assemblies by a distance of about 15 to 26 inches.

* * * * *

UNITED STATES PATENT AND TRADEMARK OFFICE

CERTIFICATE OF CORRECTION

PATENT NO. : 8,367,978 B2
APPLICATION NO. : 11/543470
DATED : February 5, 2013
INVENTOR(S) : Glenn Williams It is certified that error appears in the above-identified patent and that said Letters Patent is hereby corrected as shown below:

In the Specification:
Column 2
Line 4, "throughout out" should be --throughout--.

In the Claims:
Column 8
Line 4, "convention" should be --convection--.

Column 8,
Line 18, "convention" should be --convection--.

Signed and Sealed this
Thirtieth Day of July, 2013

Teresa Stanek Rea
*Acting Director of the United States Patent and Trademark Office*